US008033331B2

(12) United States Patent
Themig

(10) Patent No.: US 8,033,331 B2
(45) **Date of Patent: *Oct. 11, 2011**

(54) CEMENT DIFFUSER FOR ANNULUS CEMENTING

(75) Inventor: Daniel Jon Themig, Calgary (CA)

(73) Assignee: Packers Plus Energy Services, Inc., Calgary (CA)

( * ) Notice: Subject to any disclaimer, the term of this patent is extended or adjusted under 35 U.S.C. 154(b) by 15 days.

This patent is subject to a terminal disclaimer.

(21) Appl. No.: 12/860,196

(22) Filed: Aug. 20, 2010

(65) Prior Publication Data

US 2010/0307751 A1 Dec. 9, 2010

Related U.S. Application Data

(62) Division of application No. 12/108,381, filed on Apr. 23, 2008, now Pat. No. 7,798,226.

(60) Provisional application No. 61/037,602, filed on Mar. 18, 2008.

(51) Int. Cl.
*E21B 33/14* (2006.01)
*E21B 43/26* (2006.01)

(52) U.S. Cl. ..... 166/285; 166/308.1; 166/376

(58) Field of Classification Search ..... None
See application file for complete search history.

(56) References Cited

U.S. PATENT DOCUMENTS

| | | | | |
|---|---|---|---|---|
| 1,342,618 | A | 6/1920 | Bashara | |
| 1,806,073 | A | 5/1931 | MacGregor et al. | |
| 2,338,372 | A | 1/1944 | Wright | |
| 2,675,082 | A | 4/1954 | Hall | |
| 2,716,454 | A * | 8/1955 | Abendroth | 166/308.1 |
| 2,821,255 | A * | 1/1958 | Spearow | 166/271 |
| 3,176,772 | A | 4/1965 | MacGregor | |
| 3,310,113 | A | 3/1967 | Maness | |
| 4,438,812 | A | 3/1984 | Hammon | |
| 4,501,322 | A | 2/1985 | Martin | |
| 6,401,813 | B1 | 6/2002 | Carmichael et al. | |
| 6,460,617 | B1 | 10/2002 | Allen | |
| 7,798,226 | B2 * | 9/2010 | Themig | 166/285 |
| 2002/0104649 | A1 | 8/2002 | Allen | |
| 2007/0017675 | A1 | 1/2007 | Hammami et al. | |
| 2008/0210422 | A1 * | 9/2008 | Clark et al. | 166/254.2 |

* cited by examiner

*Primary Examiner* — George Suchfield
(74) *Attorney, Agent, or Firm* — Bennett Jones LLP

(57) ABSTRACT

A cement diffuser and method for allowing a ported tubular to be cemented in place, while keeping an annulus about a port of the ported tubular generally free of set cement. The cement diffuser includes a collection of fibers secured over the port and extending out from an outer surface of the tubular.

26 Claims, 2 Drawing Sheets

CEMENT DIFFUSER FOR ANNULUS CEMENTING

CROSS REFERENCE TO RELATED APPLICATIONS

This is a divisional application of U.S. application Ser. No. 12/108,381 filed Apr. 23, 2008, which is presently pending. U.S. application Ser. No. 12/108,381 and the present application claim priority under 35 U.S.C. §119(e) to U.S. provisional patent application No. 61/037,602 filed Mar. 18, 2008.

FIELD

The present invention relates to downhole tubulars and, in particular, a wellbore tubular device for assisting annulus cementing operations.

BACKGROUND

Wellbores are often completed by introduction of cement around the tubular in the annulus between the tubular and the borehole wall. The cement holds the tubular in place in the well and controls against fluid passage through the wellbore annulus.

When a ported tubular is positioned in a well, cement generally cannot be used in the usual way since the cement will block the outside of the port such that although the port is opened, fluid treatments are blocked from entering the wellbore because of the presence of the cement. If fluid is introduced at a pressure that would normally fracture the well, the force of the fluid injection is distributed over a wider area by the cement such that the force is dissipated and the treatment may be rendered less than effective.

SUMMARY

In accordance with a broad aspect of the present invention, there is provided a cement diffuser for allowing a ported tubular to be cemented in place, while keeping an annulus about a port of the ported tubular generally free of set cement, the cement diffuser comprising: a collection of fibers secured over the port and extending out from an outer surface of the tubular.

In accordance with a broad aspect of the present invention, there is provided a tubular installation in place in a borehole, the tubular installation creating an annular space between the annular installation and a wall of the borehole, the tubular installation comprising: a tubular including a wall with a port extending therethrough and a cement diffuser installed over the port and carried along with the tubular, the cement diffuser including a collection of fibers secured over the port, the collection of fibers extending radially outwardly from the port into the annular space.

In accordance with another broad aspect of the present invention, there is provided a method for installing a tubular string in a wellbore, the method comprising providing a tubular including a wall with a port extending therethrough and a cement diffuser installed over the port and carried along with the tubular, the cement diffuser including a collection of fibers secured over the port on at least the outer diameter of the tubular; running the tubular into the wellbore and thereby creating an annulus between the tubular and the wellbore wall; pumping cement into the annulus; and allowing the cement to set in the annulus, the cement diffuser creating a weak point in the cement in the annulus radially adjacent the port.

It is to be understood that other aspects of the present invention will become readily apparent to those skilled in the art from the following detailed description, wherein various embodiments of the invention are shown and described by way of illustration.

As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
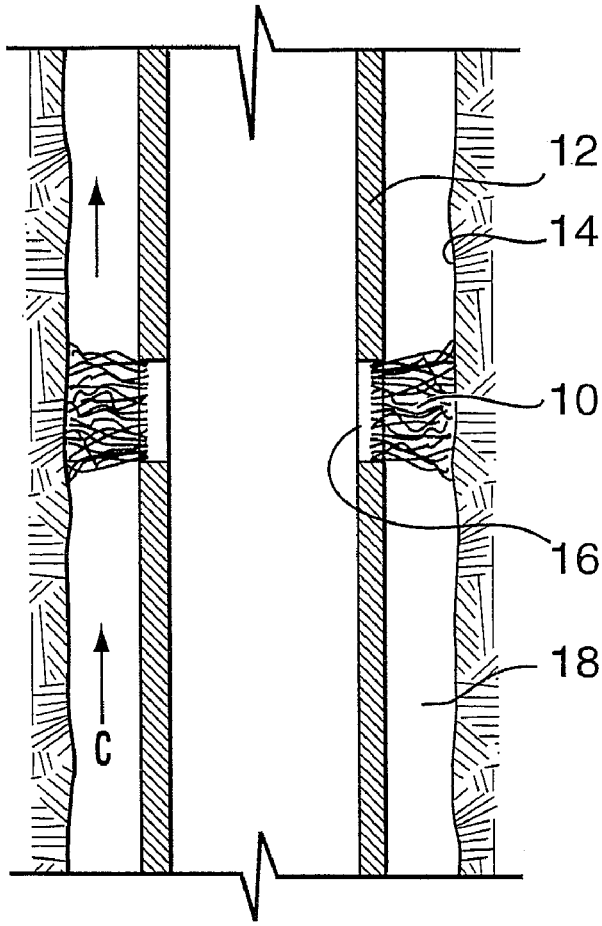
FIG. 1 is a schematic sectional view along a portion of a well bore with a ported tubular therein.

With reference to FIG. 1, a cement diffuser 10 has been invented for allowing a ported tubular 12 to be cemented in place in a wellbore, as defined by wellbore wall 14, while creating a weak point in the cement annulus radially adjacent the ports 16 of the tubular. In one embodiment, the cement diffuser maintains the annulus radially outwardly of the ports generally free of set cement.

Cement diffuser 10 includes a collection of fibers secured over the port on at least the outer surface of tubular 12. The fibers can be metal, synthetic such as of polymers or natural organic materials such as of cellulose, hemp, wood, cotton, etc. The collection of fibers is carried along with tubular 12 while running the tubular into a borehole.

The cement diffuser comes becomes useful when it is desired to cement the annular area 18 about the tubular. As will be appreciated, a cementing operation includes pumping liquid cement, arrows, into the annular area between a tubular installation and a borehole wall. This is generally done by pumping cement from surface down through the inner diameter of the tubular installation and out into the annulus, either by pumping the cement out the bottom of the tubular installation or out through a port in the tubular wall.

The fibers of the cement diffuser are positioned to substantially block clear access to the port by the cement, as the cement moves through the annulus. For example, the cement may tend not to infiltrate the fibers of the collection of fibers due to fluid dynamics, or by a chemical applied to block access into any voids between the fibers. Alternately, the cement may pass between the fibers of the cement diffuser, but the cement when set may be so thin or unstable that the cement in that area is relatively weak.

In one embodiment, the radially extended length of the collection of fibers is selected to span the annulus such that the collection of fibers at their outboard end are at least closely adjacent or possibly touching the borehole wall 14. In this way, the entire annular radial length outwardly of the port is either devoid of cement or includes only relatively weak deposits of cement. In such an embodiment, the outward extended length of fibers from the outer surface of the tubular may be selected at surface with consideration as to the expected annulus radial spacing between the tubular and the borehole wall, which will be known based on the drilling information and the known tubular outer diameter.

So as not to interfere with the annular placement of cement and the integrity of the annular cement seal, the fiber collections may be spaced apart about the circumference of the tubular leaving open areas therebetween through which the cement may flow past the ported area of the tubular, when the tubular is positioned in a borehole. Chemicals can be injected into the voids formed between the fibers of the collections, such chemicals being selected to prevent the solidification of cement in the voids.

In use, injected fluids can be passed through the tubular and out through a port over which a cement diffuser has been placed. The injected fluids will pass outwardly though the port and cement outwardly thereof, if any, is unstable, thin or weakly set. The collections of fibers either provide a path for the injected fluids to pass therethrough or can be pushed aside, expelled or broken down immediately or over time.

Figure 2:
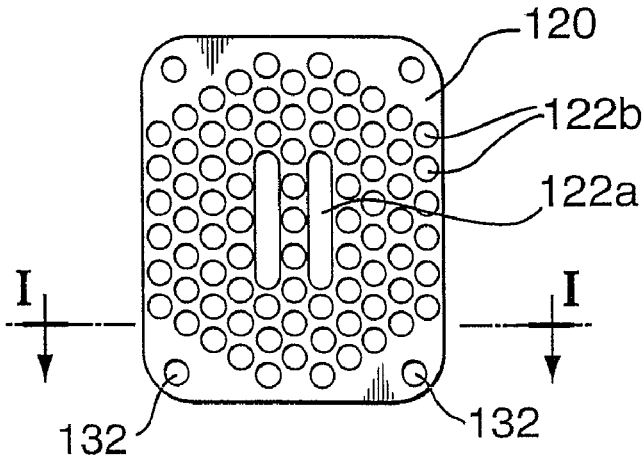
FIG. 2 is a plan view of a cement diffuser plate useful in the present invention.
Figure 3:
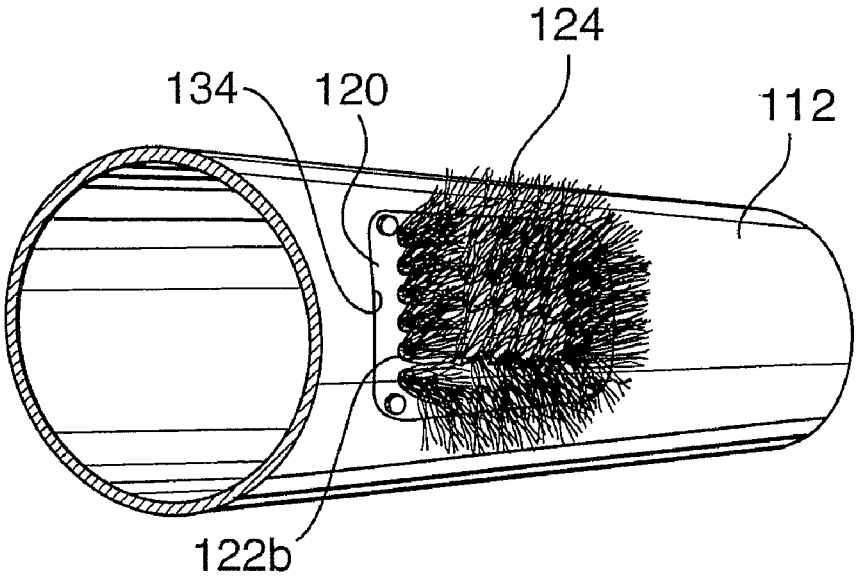
FIG. 3 is a perspective view of a cement diffuser installed on a wellbore tubular.
Figure 4:
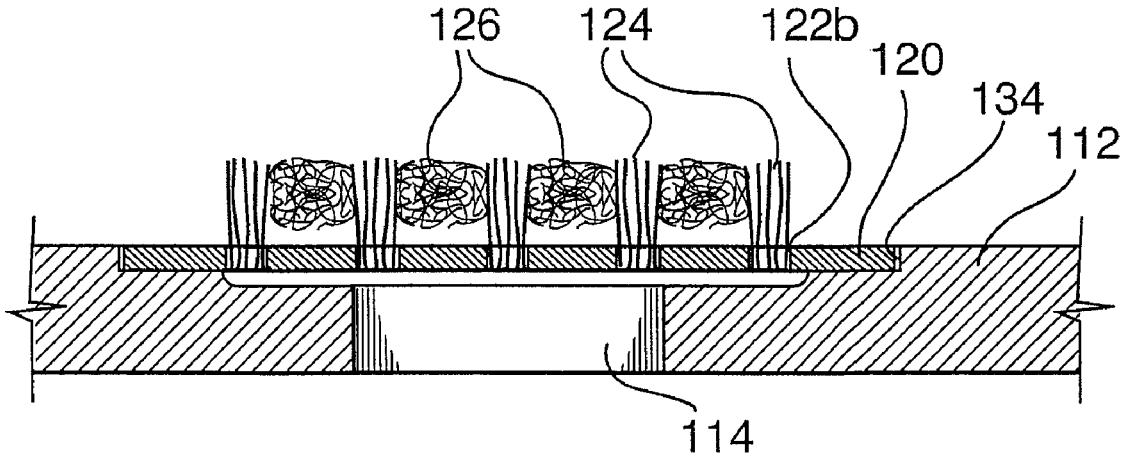
FIG. 4 is a sectional view of a cement diffuser installed on a tubular, reference may be made to line I-I of FIG. 2 for orientation of the section through the sleeve.

The fibrous collections can be secured over the ports in various ways. With reference to FIGS. 2 to 4, in one embodiment, the cement diffuser includes a plate 120 with a plurality of holes 122*a*, 122*b* therethrough that can be secured on the outside of a tubular 114 over a port 112. The holes may have various sizes and shapes, as desired. For example, in the presently illustrated embodiment of FIG. 2, larger holes 122*a*, in this illustrated case formed as slots, are positioned centrally on the plate, where greater volume flows are generally desired to be passed. Smaller holes 122*b* are formed over the remaining area of the plate.

Fibers 124 may be threaded through the holes. For example, the holes may be stuffed with fibers and the fibers may extend outwardly therefrom. The fibers may be linearly twisted in bundles, as shown. Alternately, the fibers may be individually extending or in the form of bunches, interengaged bundles, plugs, randomly arranged, linearly arranged, parallel, etc. The fibers together form a collection that extends out from the plate into the annulus about the tubular. In the illustrated embodiment, for example, fibers extend out substantially radially from the ports, relative to the circular dimension of the tubular. Fibers 124 may be selected to be long enough to touch the borehole wall of a borehole in which they are to be used. The fibers in this embodiment, form a brush like structure that can engage and ride along the borehole wall, but are threaded through the holes of the port such that they are substantially not dislodged by such engagement.

Fibers 124 may be secured to the plate such that they are forced out of the way, such as out of holes 122*a*, 122*b* of the plate when fluid injection occurs through the port 112 and plate 120. Alternately, the fibers may be installed or formed such that there remain fluid flow passages between the fibers of the plugs, when they remain in the holes. In another possible embodiment, fibers 124 may be formed of erodable or degradable materials/construction such that they break down at some point after cementing, for example, by the erosive power of the injected fluids.

Further fibers 126 of similar or, as shown, different construction/materials may be engaged between fibers 124 in the holes. In the illustrated embodiment, for example, more delicate polymeric batting is placed between the tufts formed by the bundles of fibers extending from the holes 122*a*, 122*b* of plate 120.

As noted hereinabove, chemicals can be injected into the voids formed between the fibers of the collections, such chemicals being selected to prevent the entry or solidification of cement in the voids between fibers. Such chemicals can include, for example, one or more of grease, sugar, salt, cement retarder, etc.

Plate 120 can be secured over the port in various ways, such as by fasteners 130 in apertures 132, welding, plastic deformation, etc. A recess 134 may be provided on the outer surface of the tubular about the port such that the plate can be positioned below the tubular's outer surface contour.

Fibers and chemicals can also be positioned inwardly of plate 120 to act against passage of or setting of cement in port 114 and in the inner diameter of the tubular.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A method for installing a tubular string in a wellbore, the method comprising:

providing a tubular including a wall with a port extending therethrough, and a cement diffuser installed over the port and carried along with the tubular, the cement diffuser including a collection of fibers secured over the port on at least the outer diameter of the tubular; running the tubular into the wellbore and thereby creating an annulus between the tubular and the wellbore wall; pumping cement into the annulus; allowing the cement to set in the annulus, the cement diffuser creating a weak point in the cement in the annulus radially adjacent the port; and, after allowing the cement to set, injecting fluid from the tubular through the port and into the annulus to fracture the wellbore.

2. The method of claim 1 wherein during pumping cement infiltrates voids in the collection of fibers and when allowing the cement to set, the cement in the voids sets.

3. The method of claim 1 wherein during pumping cement infiltrates voids in the collection of fibers and when allowing the cement to set, the cement in the voids is retarded from setting.

4. The method of claim 1 wherein during pumping cement is deterred from infiltrating voids in the collection of fibers by fluid dynamics.

5. The method of claim 1 wherein during pumping cement is deterred from infiltrating voids in the collection of fibers by the presence of a chemical in the collection of fibers.

6. The method of claim 1 wherein during injecting fluid through the port, the collection of fibers provides a path for the injected fluids to pass through the annular space.

7. The method of claim 1 wherein during injecting fluid through the port, the collection of fibers is pushed aside.

8. The method of claim 1 wherein during injecting fluid through the port, the collection of fibers is expelled.

9. The method of claim 1 wherein during injecting fluid through the port, the collection of fibers is broken down.

10. The method of claim 1 wherein during pumping, cement is pumped into the annulus through a bottom end of the tubular string.

11. The method of claim 1 wherein pumping cement further includes acting against passage of cement into the port.

12. The method of claim 1 wherein the collection of fibers include a plurality of fibers extending substantially radially out from the tubular, relative to a circular dimension of the tubular.

13. The method of claim 12 further comprising selecting the length of the plurality of fibers to touch the wellbore wall, when the tubular is run into the wellbore.

14. A method for treating a wellbore, the method comprising: running a tubular string into the wellbore, thereby creating an annulus between the tubular string and a wall of the wellbore, the tubular string including an inner diameter, a bottom end and a tubular installed along the tubular string, the tubular including a wall with a port extending therethrough and a cement diffuser installed over the port and carried along with the tubular, the cement diffuser including a collection of fibers secured over the port on at least the outer diameter of the tubular; pumping cement through the tubular string inner diameter and into the annulus to pass through the annulus and about the cement diffuser, while acting against passage of cement through the port; allowing the cement to set in the annulus to provide a cemented annulus; and, after allowing the cement to set, injecting fluid from the tubular string inner diameter through the port and through a weak point in the cemented annulus created by the cement diffuser to fracture the wellbore.

15. The method of claim 14 wherein during pumping cement infiltrates voids in the collection of fibers and when allowing the cement to set, the cement in the voids sets.

16. The method of claim 14 wherein during pumping cement infiltrates voids in the collection of fibers and when allowing the cement to set, the cement in the voids is retarded from setting.

17. The method of claim 14 wherein during pumping cement fails to infiltrate voids in the collection of fibers.

18. The method of claim 14 wherein during pumping cement is deterred from infiltrating voids in the collection of fibers by the presence of a chemical in the collection of fibers.

19. The method of claim 14 wherein the weak point is a void the cemented annulus and during injecting, the injected fluids pass through the void in the cemented annulus.

20. The method of claim 14 wherein the weak point is an unstable region in the cemented annulus and during injecting, the injected fluids pass through the unstable region in the cement annulus.

21. The method of claim 14 wherein during injecting, the collection of fibers is pushed aside.

22. The method of claim 14 wherein during injecting fluid through the port, the collection of fibers is expelled.

23. The method of claim 14 wherein during injecting fluid through the port, the collection of fibers is broken down.

24. The method of claim 14 wherein during pumping, cement is pumped through the bottom end of the tubular string into the annulus.

25. The method of claim 14 wherein the collection of fibers include a plurality of fibers extending substantially radially out from the tubular, relative to a circular dimension of the tubular.

26. The method of claim 25 further comprising selecting the length of the plurality of fibers to touch the wellbore wall, when the tubular is run into the wellbore.

* * * * *